US006682148B1

(12) United States Patent
Chen

(10) Patent No.: US 6,682,148 B1
(45) Date of Patent: Jan. 27, 2004

(54) BABY ROCKING CHAIR FRAME

(76) Inventor: Owen Chen, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/330,978

(22) Filed: Dec. 25, 2002

(51) Int. Cl.[7] ..... A47D 1/00
(52) U.S. Cl. ..... 297/440.24; 297/DIG. 11
(58) Field of Search ..... 297/440.24, DIG. 11, 297/32, 255

(56) References Cited

U.S. PATENT DOCUMENTS 3,017,220 A * 1/1962 Chernivsky ..... 297/467
5,411,315 A * 5/1995 Greenwood ..... 297/440.24
5,503,458 A * 4/1996 Petrie ..... 297/452.13
5,507,564 A * 4/1996 Huang ..... 297/452.13
5,868,459 A * 2/1999 Welsh, Jr. ..... 297/32
6,616,237 B2 * 9/2003 Sonner et al. ..... 297/440.22

* cited by examiner

*Primary Examiner*—Peter M. Cuomo
*Assistant Examiner*—Joseph Edell

(57) ABSTRACT

A baby rocking chair frame has a connection device, a first generally V-shaped base frame, a second generally V-shaped base frame, and a U-shaped frame. The U-shaped frame has a pair of generally cross-shaped holes, a pair of threaded apertures, and a first collar and a second collar inserted in two ends of the U-shaped frame. The first generally V-shaped base frame has a first end inserted in the first collar, and a second end having a first protruded block. The second generally V-shaped base frame has a first end inserted in the second collar, and a second end having a second protruded block. The connection device is connected to the second end of the first generally V-shaped base frame and the second end of the second generally V-shaped base frame.

6 Claims, 8 Drawing Sheets

BABY ROCKING CHAIR FRAME

BACKGROUND OF THE INVENTION

The present invention relates to a rocking chair frame. More particularly, the present invention relates to a baby rocking chair frame.

A conventional baby rocking chair frame is similar to a rocking chair frame for an adult. The conventional baby rocking chair frame cannot be detached conveniently.

SUMMARY OF THE INVENTION

An object of the present invention is to provide a baby rocking chair frame which is easily detached.

Another object of the present invention is to provide a baby rocking chair frame which is easily folded.

Another object of the present invention is to provide a baby rocking chair frame which is easily expanded.

Accordingly, a baby rocking chair frame comprises a first generally V-shaped base frame, a second generally V-shaped base frame, and a U-shaped frame. The U-shaped frame has a pair of generally cross-shaped holes, a pair of threaded apertures, and a first collar and a second collar inserted in two ends of the U-shaped frame. The first generally V-shaped base frame has a first end inserted in the first collar, and a second end having a first protruded block. The second generally V-shaped base frame has a first end inserted in the second collar, and a second end having a second protruded block. The first collar has a first through aperture to match the corresponding threaded aperture of the U-shaped frame. The second collar has a second through aperture to match the corresponding threaded aperture of the U-shaped frame. A connection device has a main block having a through hole, a connection lever having a first end pivot hole and a second pivot hole, a first slide block, a first stop mount, a first button, a second slide block, a second stop mount, and a second button. The first slide block has a first generally cross-shaped aperture, a pair of first inner grooves communicating with the first generally cross-shaped aperture, a first side lug having a first round hole, and a first head lug having a first circular hole. The first stop mount has a first flat head, a first notch, and a first round aperture. The second slide block has a second generally cross-shaped aperture, a pair of second inner grooves communicating with the second generally cross-shaped aperture, a second side lug having a second round hole, and a second head lug having a second circular hole. The second stop mount has a second flat head, a second notch, and a second round aperture. The connection lever passes through the through hole of the main block. The second end of the first generally V-shaped base frame is inserted in the first generally cross-shaped aperture of the first slide block. The second end of the second generally V-shaped base frame is inserted in the second generally cross-shaped aperture of the second slide block. The connection lever is connected to the first side lug and the second side lug. The first head lug is inserted in the first notch of the first stop mount. The second head lug is inserted in the second notch of the second stop mount. The first button fastens the first stop mount and the first head lug together. The second button fastens the second stop mount and the second head lug together.

DETAILED DESCRIPTION OF THE INVENTION

Figure 1:
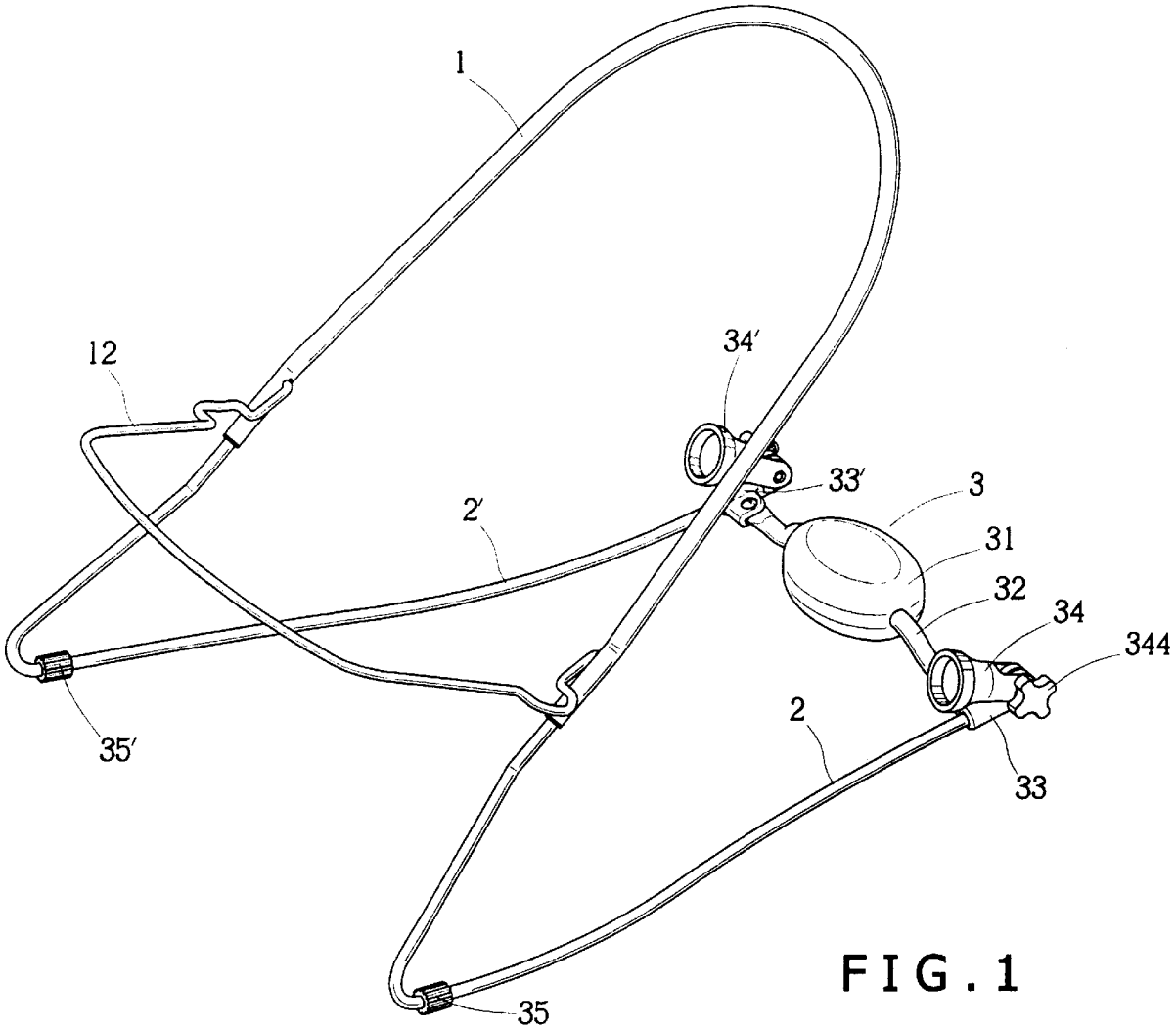
FIG. 1 is a perspective assembly view of a baby rocking chair frame of a preferred embodiment in accordance with the present invention.
Figure 2:
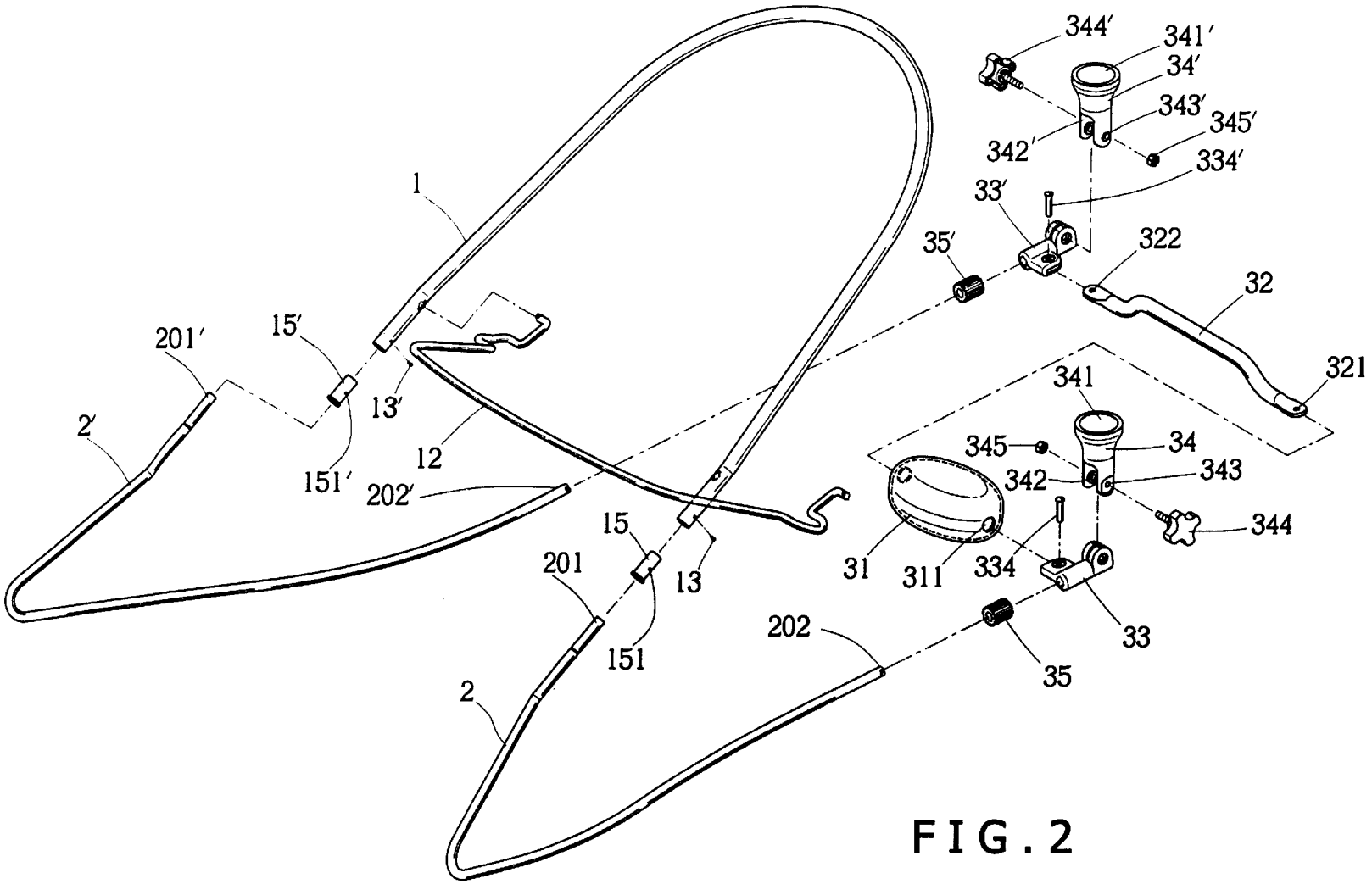
FIG. 2 is a perspective exploded view of a baby rocking chair frame of a preferred embodiment in accordance with the present invention.
Figure 4A:
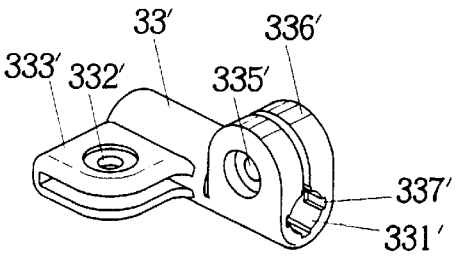
FIG. 4A is a perspective view of a second slide block of a preferred embodiment in accordance with the present invention.
Figure 4:
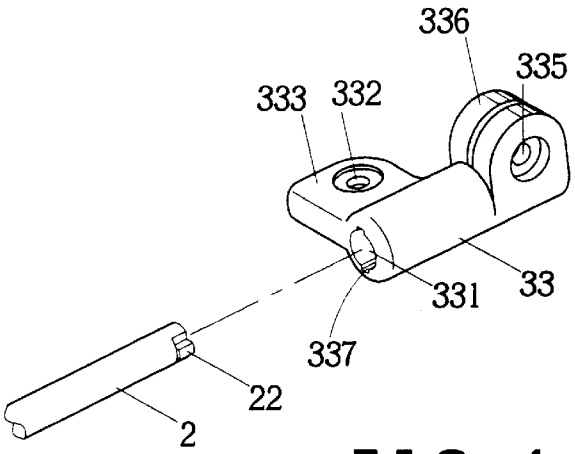
FIG. 4 is a perspective exploded view of a generally V-shaped base frame and a first slide block of a preferred embodiment in accordance with the present invention.
Figure 3:
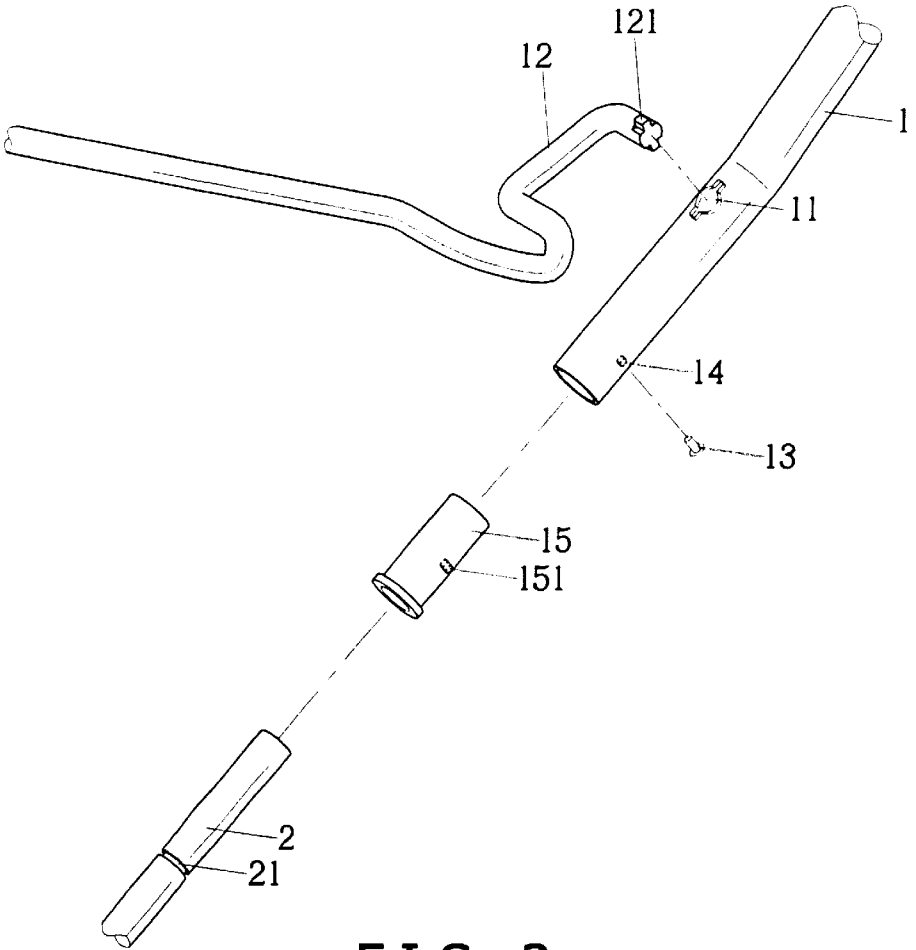
FIG. 3 is a partially perspective exploded view of a protective frame, a generally V-shaped base frame, and a U-shaped frame of a preferred embodiment in accordance with the present invention.
Figure 5A:
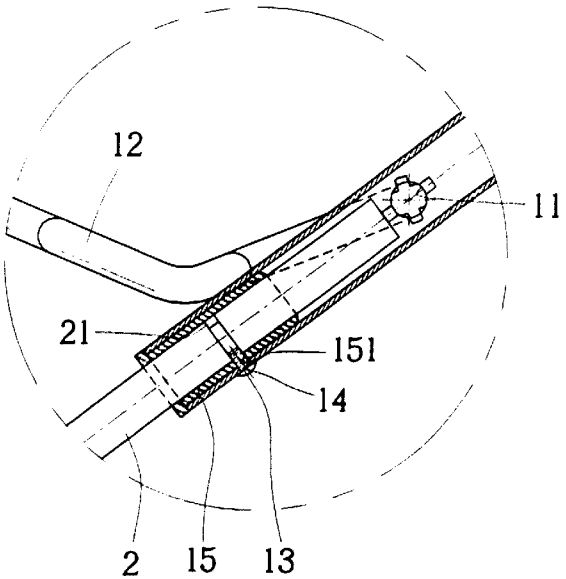
FIG. 5A is a sectional assembly view of a protective frame, a generally V-shaped base frame, and a U-shaped frame of a preferred embodiment in accordance with the present invention.
Figure 5:
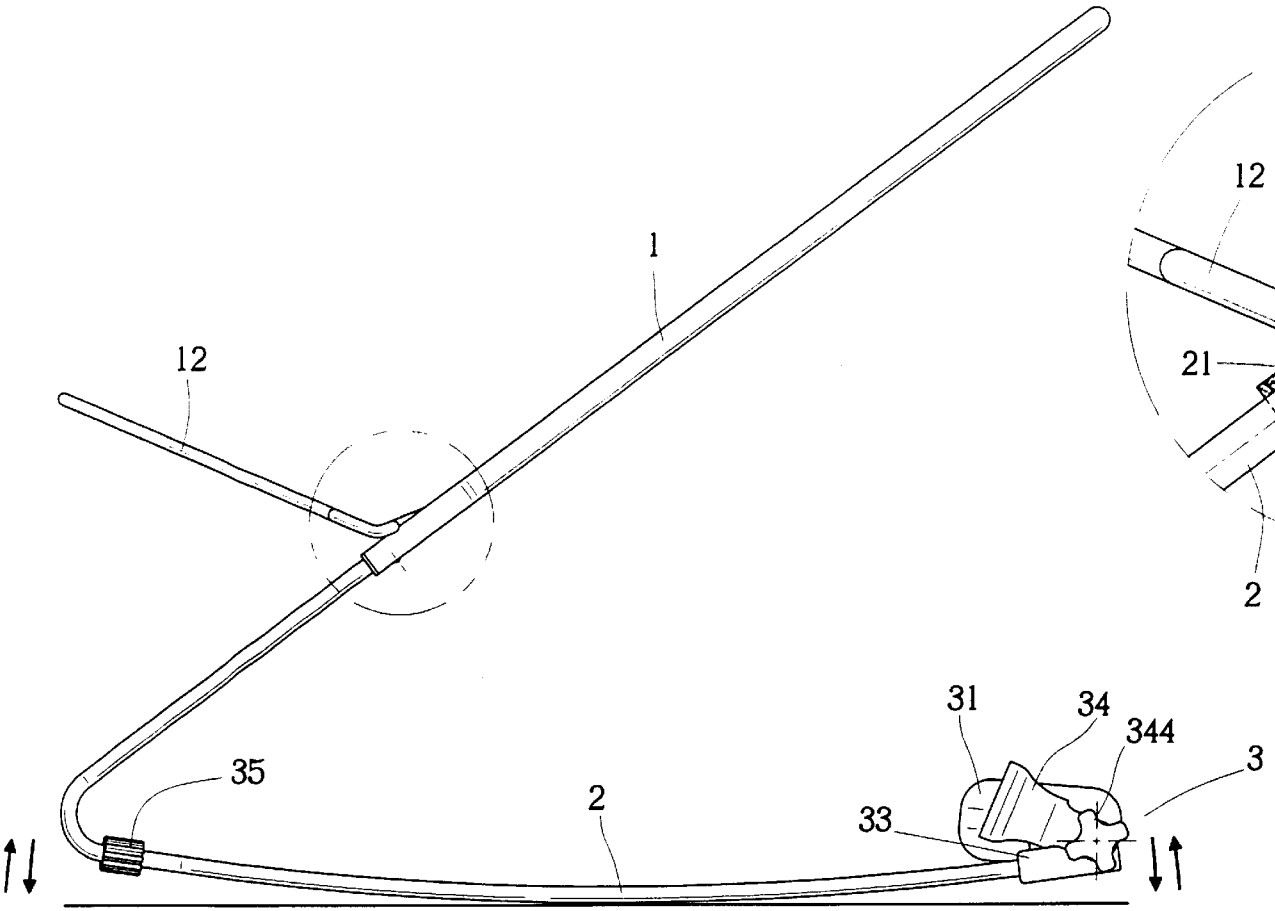
FIG. 5 is a schematic view illustrating a rocking operation of a baby rocking chair frame of a preferred embodiment in accordance with the present invention.

Referring to FIGS. 1 to 9, a baby rocking chair frame comprises a connection device 3, a first generally V-shaped base frame 2, a second generally V-shaped base frame 2', and a U-shaped frame 1.

The U-shaped frame 1 has a pair of generally cross-shaped holes 11, a pair of threaded apertures 14, and a first collar 15 and a second collar 15' inserted in two ends of the U-shaped frame 1.

The first generally V-shaped base frame 2 has a first end 201 inserted in the first collar 15, and a second end 202 having a first protruded block 22.

The second generally V-shaped base frame 2' has a first end 201' inserted in the second collar 15', and a second end 202' having a second protruded block 22'.

The first collar 15 has a first through aperture 151 to match the corresponding threaded aperture 14 of the U-shaped frame 1.

The second collar 15' has a second through aperture 151' to match the corresponding threaded aperture 14 of the U-shaped frame 1.

The connection device 3 is connected to the second end 202 of the first generally V-shaped base frame 2 and the second end 202' of the second generally V-shaped base frame 2'.

The connection device 3 has a main block 31 having a through hole 311, a connection lever 32 having a first end pivot hole, 321 and a second pivot hole 322, a first slide block 33, a first stop mount 34, a first button 344, a second slide block 33', a second stop mount 34', and a second button 344'.

The first slide block 33 has a first generally cross-shaped aperture 331, a pair of first inner grooves 337 communicating with the first generally cross-shaped aperture 331, a first side lug 333 having a first round hole 332, and a first head lug 336 having a first circular hole 335.

The first stop mount 34 has a first flat head 341, a first notch 342, and a first round aperture 343.

The second slide block 33' has a second generally cross-shaped aperture 331', a pair of second inner grooves 337' communicating with the second generally cross-shaped aperture 331', a second side lug 333' having a second round hole 332', and a second head lug 336' having a second circular hole 335'.

The second stop mount 34' has a second flat head 341', a second notch 342', and a second round aperture 343'.

The connection lever 32 passes through the through hole 311 of the main block 31.

The second end 202 of the first generally V-shaped base frame 2 is inserted in the first generally cross-shaped aperture 331 of the first slide block 33.

The second end 202' of the second generally V-shaped base frame 2' is inserted in the second generally cross-shaped aperture 331' of the second slide block 33'.

The connection lever 32 is connected to the first side lug 333 and the second side lug 333'.

A first pivot shaft 334 is inserted through the first round hole 332 of the first slide block 33 and the first end pivot hole 321 of the connection lever 32.

A second pivot shaft 334' is inserted through the second round hole 332' of the second slide block 33' and the second pivot hole 322 of the connection lever 32.

The first head lug 336 is inserted in the first notch 342 of the first stop mount 34.

The second head lug 336' is inserted in the second notch 342' of the second stop mount 34'.

The first button 344 fastens the first stop mount 34 and the first head lug 336 together.

The second button 344' fastens the second stop mount 34' and the second head lug 336' together.

A first nut 345 engages with the first button 344.

A second nut 345 engages with the second button 344'.

A first bolt 13 is inserted in the corresponding threaded aperture 14 of the U-shaped frame 1 and the first through aperture 151 of the first collar 15.

A second bolt 13' is inserted in the corresponding threaded aperture 14 of the U-shaped frame 1 and the second through aperture 151' of the second collar 15'.

A first ring 35 surrounds the first generally V-shaped base frame 2.

A second ring 35' surrounds the second generally V-shaped base frame 2'.

The first generally V-shaped base frame 2 further has an annular recess 21.

A protective frame 12 has two ends connected to the U-shaped frame 1.

The protective frame 12 has an end protrusion 121 inserted in one of the generally cross-shaped holes 11 of the U-shaped frame 1.

The first protruded block 22 is inserted in one of the first inner grooves 337 of the first slide block 33.

The second protruded block 22' is inserted in one of the second inner grooves 337' of the second slide block 33'.

Referring to FIG. 5 again, the first flat head 341 of the first stop mount 34 and the second flat head 341' of the second stop mount 34' do not contact the ground so that the baby rocking chair frame will be rocked.

Figure 6:
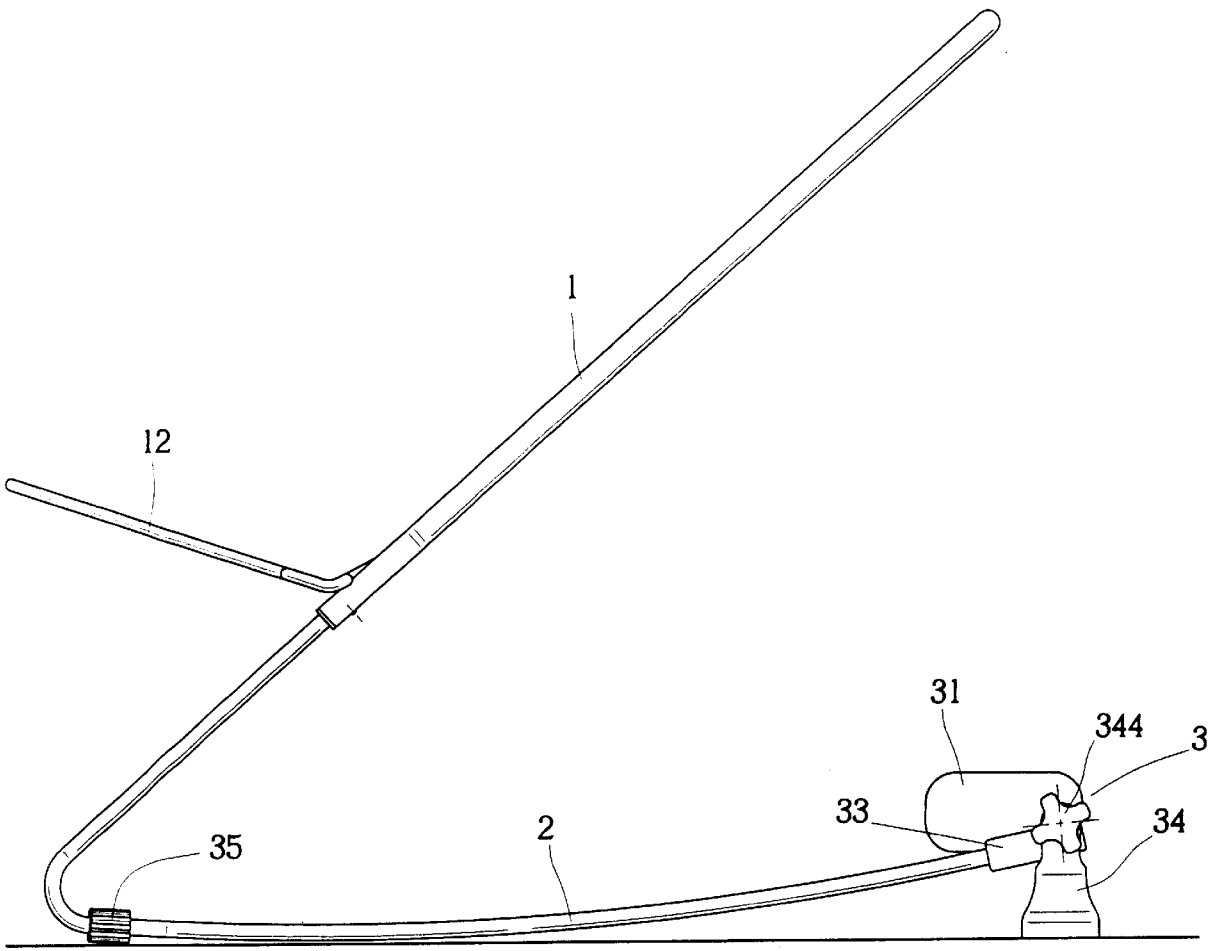
FIG. 6 is a schematic view illustrating a baby rocking chair frame of a preferred embodiment cannot be rocked while a flat head of a stop mount contacting a ground.

FIG. 6 shows the baby rocking chair frame cannot be rocked while the first flat head 341 of the first stop mount 34 and the second flat head 341' of the second stop mount 34' contacting the ground.

Figure 7:
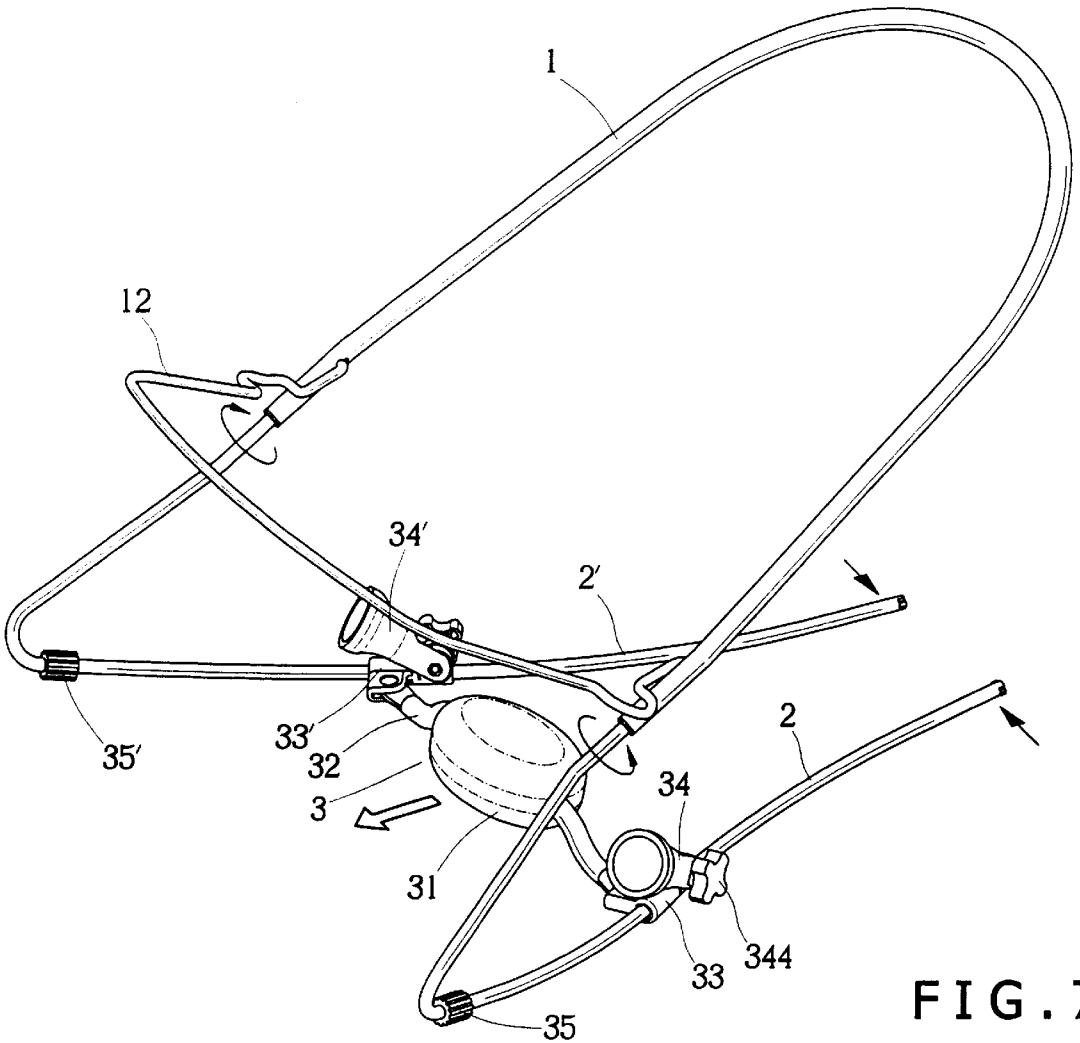
FIG. 7 is a schematic view illustrating a folding operation of a baby rocking chair frame of a preferred embodiment in accordance with the present invention.

FIG. 7 is a schematic view illustrating a folding operation of the baby rocking chair frame. The connection device 3 is moved forward toward the first ring 35 and the second ring 35'.

Figure 8:
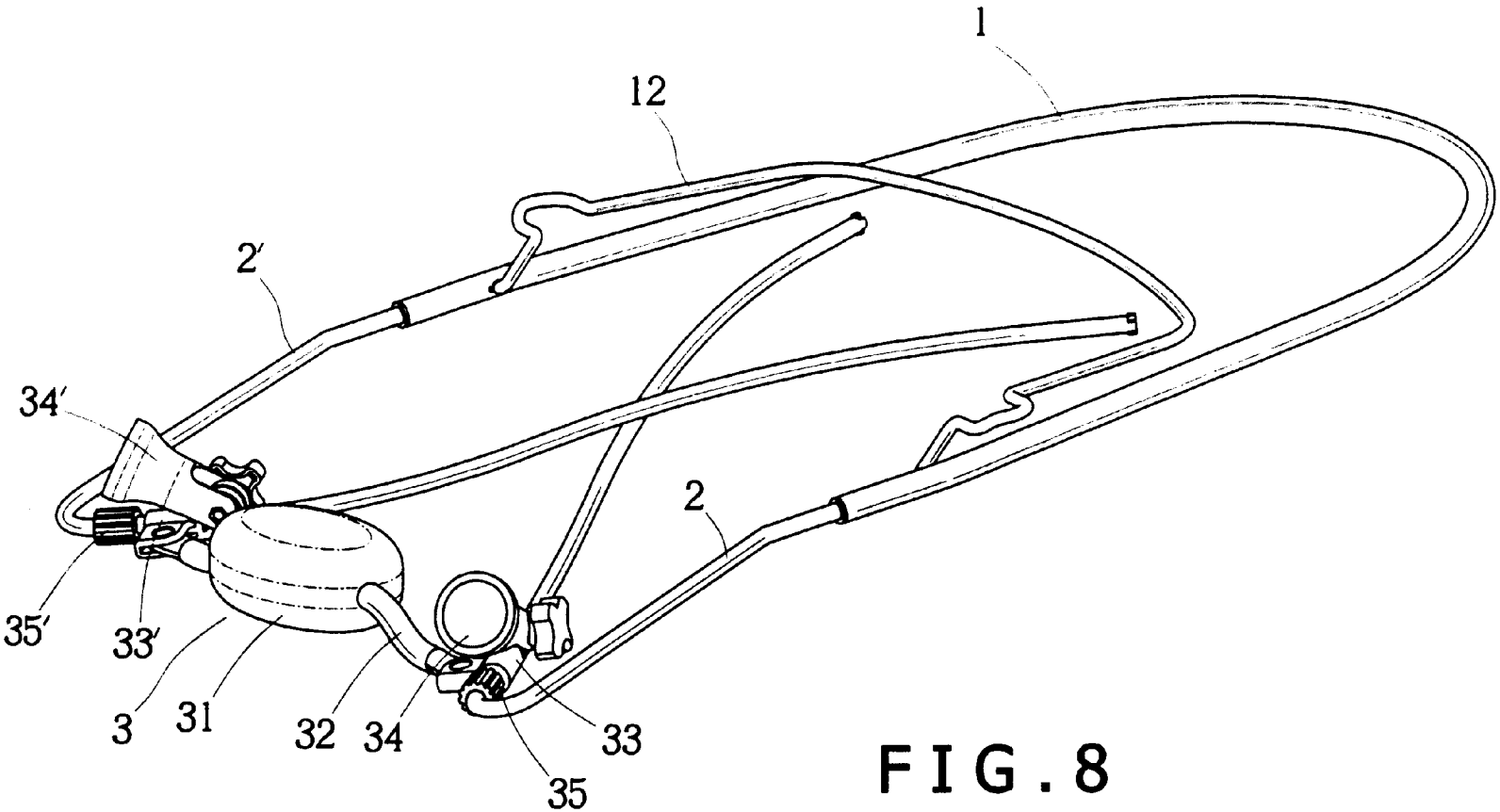
FIG. 8 is a schematic view illustrating a baby rocking chair frame of a preferred embodiment is folded.

FIG. 8 is a schematic view illustrating a baby rocking chair frame is folded. The first slide block 33 contacts the first ring 35 and the second slide block 33' contacts the second ring 35'. Then the baby rocking chair frame is folded into a compact configuration.

Figure 9:
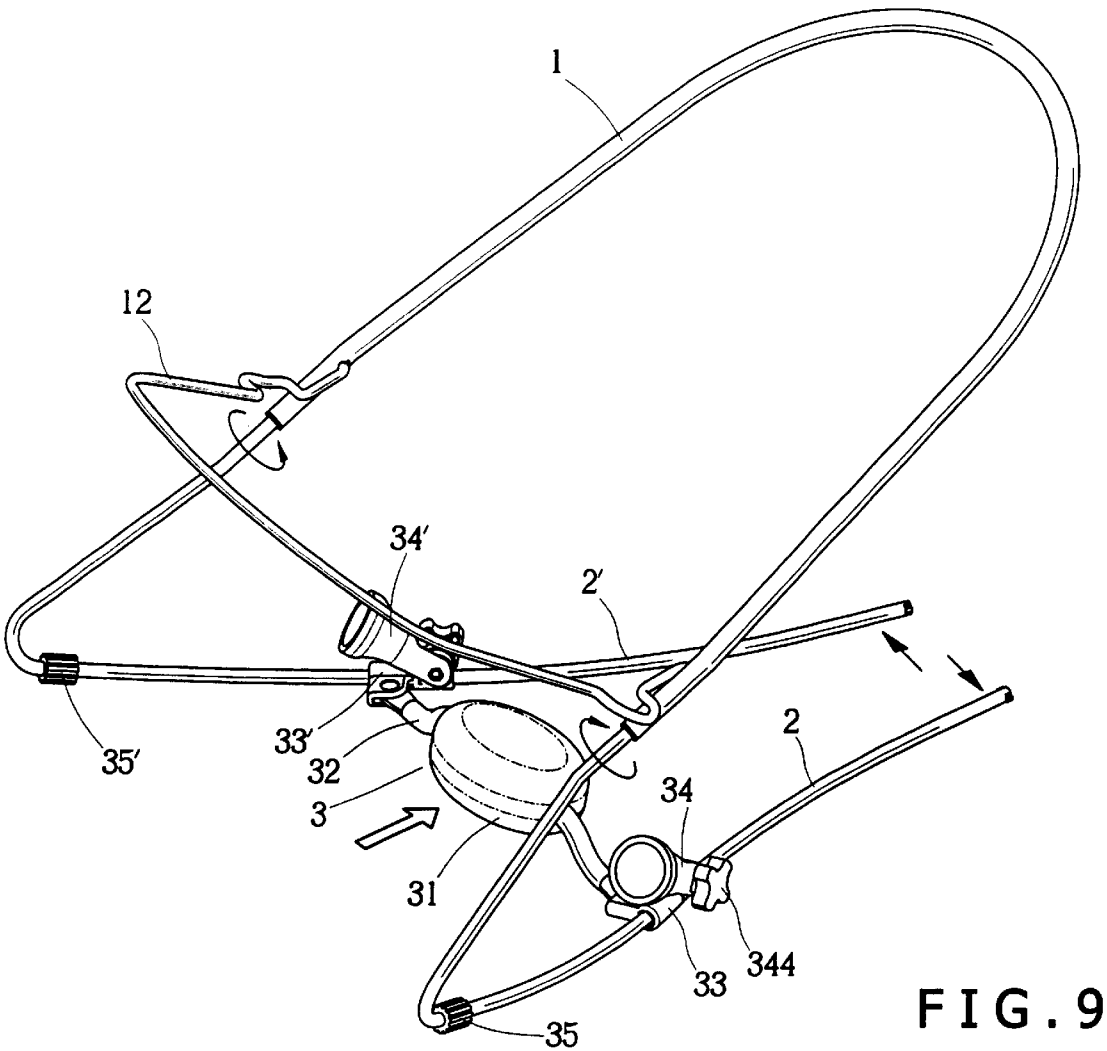
FIG. 9 is a schematic view illustrating an expanding operation of a baby rocking chair frame of a preferred embodiment in accordance with the present invention.

FIG. 9 is a schematic view illustrating an expanding operation of a baby rocking chair frame. The connection device 3 is moved rearward until the first protruded block 22 is inserted in one of the first inner grooves 337 of the first slide block 33 and the second protruded block 22' is inserted in one of the second inner grooves 337' of the second slide block 33'. Then the baby rocking chair frame is expanded.

The present invention has the following advantages. The baby rocking chair frame is easily detached. The baby rocking chair frame is easily folded. The baby rocking chair frame is easily expanded.

The invention is not limited to the above embodiment but various modification thereof may be made. Further, various changes in form and detail may be made without departing from the scope of the invention.

I claim:

1. A baby rocking chair frame comprises:

a first generally V-shaped base frame, a second generally V-shaped base frame, and a U-shaped frame, the U-shaped frame having a pair of generally cross-shaped holes, a pair of threaded apertures, and a first collar and a second collar inserted in two ends of the U-shaped frame, the first generally V-shaped base frame having a first end inserted in the first collar, and a second end having a first protruded block, the second generally V-shaped base frame having a first end inserted in the second collar, and a second end having a second protruded block, the first collar having a first through aperture to match the corresponding threaded aperture of the U-shaped frame, the second collar having a second through aperture to match the corresponding threaded aperture of the U-shaped frame, a connection device having a main block having a through hole, a connection lever having a first end pivot hole and a second pivot hole, a first slide block, a first stop mount, a first button, a second slide block, a second stop mount, and a second button, the first slide block having a first generally cross-shaped aperture, a pair of first inner grooves communicating with the first generally cross-shaped aperture, a first side lug having a first round hole, and a first head lug having a first circular hole, the first stop mount having a first flat head, a first notch, and a first round aperture, the second slide block having a second generally cross-shaped aperture, a pair of second inner grooves communicating with the second generally cross-shaped aperture, a second side lug having a second round hole, and a second head lug having a second circular hole, the second stop mount having a second flat head, a second notch, and a second round aperture, the connection lever passing through the through hole of the main block, the second end of the first generally V-shaped base frame inserted in the first generally cross-shaped aperture of the first slide block, the second end of the second generally V-shaped base frame inserted in the second generally cross-shaped aperture of the second slide block, the connection lever connected to the first side lug and the second side lug, the first head lug inserted in the first notch of the first stop mount, the second head lug inserted in the second notch of the second stop mount, the first button fastening the first stop mount and the first head lug together, and the second button fastening the second stop mount and the second head lug together.

2. The baby rocking chair frame as claimed in claim 1, wherein a first pivot shaft is inserted through the first round hole of the first slide block and the first end pivot hole of the connection lever, and a second pivot shaft is inserted through the second round hole of the second slide block and the second pivot hole of the connection lever.

3. The baby rocking chair frame as claimed in claim 1, wherein a first bolt is inserted in the corresponding threaded aperture of the U-shaped frame and the first through aperture of the first collar, and a second bolt is inserted in the corresponding threaded aperture of the U-shaped frame and the second through aperture of the second collar.

4. The baby rocking chair frame as claimed in claim 1, wherein a first ring surrounds the first generally V-shaped base frame, and a second ring surrounds the second generally V-shaped base frame.

5. The baby rocking chair frame as claimed in claim 1, wherein a protective frame has two ends connected to the U-shaped frame.

6. The baby rocking chair frame as claimed in claim 5, wherein the protective frame has an end protrusion inserted in one of the generally cross-shaped holes of the U-shaped frame.

* * * * *